US008226022B2

(12) United States Patent
Bongratz

(10) Patent No.: US 8,226,022 B2
(45) Date of Patent: Jul. 24, 2012

(54) MIXER WITH A CHOPPER

(75) Inventor: Howard Bongratz, Gurnee, IL (US)

(73) Assignee: Eirich Machines, Inc., Gurnee, IL (US)

( * ) Notice: Subject to any disclaimer, the term of this patent is extended or adjusted under 35 U.S.C. 154(b) by 106 days.

(21) Appl. No.: 12/845,438

(22) Filed: Jul. 28, 2010

(65) Prior Publication Data

US 2012/0024996 A1 Feb. 2, 2012

(51) Int. Cl.
*B02C 19/00* (2006.01)

(52) U.S. Cl. ..... 241/101.8

(58) Field of Classification Search ..... 241/101.8
See application file for complete search history.

(56) References Cited

U.S. PATENT DOCUMENTS

| | | | | |
|---|---|---|---|---|
| RE29,387 | E | 9/1977 | Lund | |
| 4,278,355 | A | 7/1981 | Forberg | |
| 4,756,626 | A | 7/1988 | Neier | |
| 5,048,764 | A | 9/1991 | Flament | |
| 5,094,541 | A | 3/1992 | Nelson | |
| 5,249,751 | A * | 10/1993 | Schuler | 241/222 |
| 5,505,536 | A | 4/1996 | Schuchardt | |
| 5,669,710 | A | 9/1997 | Schebesta et al. | |
| 5,791,779 | A | 8/1998 | Smith, Sr. | |
| 6,029,919 | A | 2/2000 | Rousseau | |
| 6,076,754 | A | 6/2000 | Kesig et al. | |
| 6,260,995 | B1 | 7/2001 | Schuchardt | |
| 6,268,082 | B1 * | 7/2001 | Hiruma et al. | 429/218.1 |
| 6,390,665 | B1 | 5/2002 | Silveria | |
| 6,508,423 | B2 * | 1/2003 | Gloor | 241/57 |
| 6,981,667 | B2 | 1/2006 | Hunag | |
| 7,048,218 | B2 | 5/2006 | Hunag | |
| 7,556,214 | B2 | 7/2009 | Parrett et al. | |
| 7,591,072 | B2 | 9/2009 | Stravitz | |

FOREIGN PATENT DOCUMENTS

JP 08118345 * 5/1996

OTHER PUBLICATIONS

Forberg Fluidized Zone Mixers, APS Mixing Technology, American Process Systems, Brochure APS: FZM Apr. 1999.

The Next Generation in Mixing OptimaBlend Fluidizing Paddle Blenders, Mixing Technology, American Process System, Mar. 2008.

International Search Report and Written Opinion in PCT/US2011/044201, dated Dec. 14, 2011, 9 pages.

* cited by examiner

*Primary Examiner* — Mark Rosenbaum
(74) *Attorney, Agent, or Firm* — McCracken & Frank LLC

(57) ABSTRACT

A mixer for mixing and/or blending product, such as granular material, includes a chopper disposed above an agitator assembly. The chopper preferably includes two sets of intersecting chopper blades that rotate in opposing synchronized motion in a zone of fluidized flow of product caused by the agitator assembly. A shroud above the chopper can be used to redirect product sprayed upwardly from the chopper blades back laterally into the zone of fluidized flow of product.

19 Claims, 3 Drawing Sheets

MIXER WITH A CHOPPER

BACKGROUND OF THE INVENTION

1. Field of the Invention

The present invention relates to industrial mixers for granular products.

2. Description of the Background of the Invention

Mixers for mixing various granular materials together into a relatively homogenous blend come in many different configurations. One traditional mixer configuration is a so-called U-shaped mixer, wherein a blending or mixing apparatus includes one or more agitator assemblies, each including one or more agitators mounted on a horizontal rotatable shaft and carried in an elongate horizontal U-shaped hopper. The U-shaped hopper is sized to closely fit around the mixing apparatus along the length of the shaft so that the agitator(s) engage the entire product in the hopper when the shaft is rotated in order to assure complete blending and/or mixing of the various granular materials. Traditional U-shaped mixers are frequently configured with an agitator that has an auger or ribbons, paddles, or a combination of styles of mixing tools that move the product both axially along the length of the shaft and circumferentially around the shaft in a circular-cylindrical sweep area defined by the rotational periphery of the agitators. The agitator assemblies in such mixers are primarily used to mix the product in the trough without breaking up larger grains or clumps of aggregated product into smaller sizes.

It is also often necessary or desirable to break up larger chunks of the product at the same time the product is being mixed. Therefore, in the past, one or more choppers have been added to mixers in order to help break down and/or reduce the size of agglomerates or clumps or granules that may be created by many conditions, to increase dispersion of particles in the agitator assembly, and/or to provide a desired finish to a granular product being blended. Traditionally, a chopper has been disposed on an inside wall of the trough below the horizontal center of the agitator assembly in order to be buried under the upper surface of the product and ensure that the product is fully engaged by the chopper at all times.

In one example shown in FIG. 1A, a traditional low-speed U-shaped mixer has an agitator 10, such as an auger or a ribbon extending radially from a horizontal shaft, that simply pushes and mixes product 12 in the trough 14 without substantially suspending the product 12 into the air. This mixer does not have the capacity to impart the movement to the product 12 to compare with the performance seen in newer generations of mixer because of the low rotational speed of the agitator 10. Rather, a wedge-shaped region (not shown) of product 12 is formed along the straight sidewall of the trough 14 above the centerline of the agitator 10 and below the top of the agitator 10 that will only have product 12 therein when the volume of product 12 in the trough 14 is sufficient to mechanically push the product 12 upwardly into it. A chopper 16 is disposed on an inside wall of the trough approximately thirty degrees below the horizontal level of the shaft. The chopper has a single shaft extending through the wall of the trough and two sets of radial blades disposed on the shaft and located within the sweep area of the agitators. Therefore, the ribbon or auger must have one or more breaks at the longitudinal location of the chopper 16 in order to provide clearance between the agitator 10 and the chopper 16. These breaks in the ribbon or auger can hurt the efficiency of the mixing/blending action of the mixer. However, the location of the chopper within the sweep area of the agitator buried under the upper surface (shown in phantom) of the product 12 is necessary to ensure that the product is fully engaged by the chopper 16.

Newer mixers often work at higher speeds and can create so-called fluidized zones where product is temporarily suspended in the air. A fluidized zone is a zone where the product is actually temporarily suspended or floating in the air. A fluidized zone is created because the paddles actually lift and throw the product above an at-rest upper surface of the product in such manner that the product is temporarily flying through the air in a fluidized zone when the shaft rotates at higher speeds. For example, FIG. 1B shows a high-speed U-shaped mixer that has two parallel agitator assemblies 18 and a chopper 16. Each agitator assembly 18 includes a plurality of arms that extend radially from a horizontal rotatable shaft in a double U-shaped trough 20 and a paddle disposed at the end of each arm. The agitator assemblies 18 overlap and rotate in opposite directions with the right agitator assembly rotating clockwise (as viewed from either end) and the left agitator assembly rotating counter-clockwise such that the paddles rotate upwardly in a central region where the agitator assemblies overlap. The agitator assemblies 18 have a rotational speed capacity that creates a fluidized zone of product (not shown) in the trough above the area of overlap therebetween, and the product moves generally across the top of the agitator assemblies 18 from the center of the trough 20 toward opposite side walls of the trough 20. Thus, these newer U-shaped mixers are often called fluidizing mixers due to the formation of such fluidized zone or zones within and/or above the region encompassed by the agitator assemblies 18. A detailed example of one type of fluidized mixer, which has two agitators disposed in a double U-shaped trough, is provided in U.S. Pat. No. 4,278,355 to Forberg, which is incorporated by reference herein. In FIG. 1B, the chopper 16 extends into the sweep area of one the agitator assemblies 18 through the side wall of the trough 20 at a location approximately thirty degrees below the shaft of the agitator assembly in order to ensure engagement with the product as the product moves down the sidewalls of the trough. Again, the agitator assembly 18 must be modified to have a break in the sweep area of the paddles in order to avoid hitting the chopper 16, which disrupts a preferred even flow of product through the trough 20.

FIG. 1C shows another type of fluidizing U-shaped mixer that has only a single agitator assembly 22 in a U-shaped trough 14 and a chopper 16 projecting into the sweep area of the agitator assembly 22 below the shaft. In this mixer, the agitator assembly 22 includes a multiple-zone hybrid paddle agitator to mix the product 12 more gently and faster than traditional low-speed mixers and provide flow characteristics of the product 12 that allow the mixer to achieve desired mixing characteristics with the single agitator assembly 22, rather than using the two agitator assemblies 18 like the mixer of FIG. 1B. The agitator assembly 22 has paddles 24 with angular orientations selected to impart desired flow of product that are disposed at the distal ends of arms 26 of different lengths. The different radial placements and angular orientations of the paddles 24 form different radial zones of movement in the trough. For example, the radially inner paddles may move the product 12 in one longitudinal direction along the shaft in an inner zone and the radially outer paddles may move the product 12 in an opposite longitudinal direction along the shaft in an outer zone, thus causing the product 12 to circulate back and forth completely through the trough with only the one agitator assembly 22. The chopper 16 is disposed on an inside wall of the trough approximately thirty degrees below the horizontal level of the shaft in order to be buried under the upper surface of the product and ensure that the product is fully engaged by the chopper 16. Again, the placement of the chopper 16 within the sweep zone of the agitator assembly requires a break in the sweep area of the agitator assembly, which can reduce the efficiency of the circulation and mixing of the product.

A number of difficulties are created by this traditional placement of the chopper below the level of the product at rest. For example, this placement provides a significant amount of resistance to rotating the chopper, which requires a larger motor and more power to start and run the chopper 16. Further, this placement requires a break or opening to be formed in the sweep area along the length of the agitator assembly so that the agitator arms do not hit the chopper during operation, which requires a modification of the agitator arms. This opening leaves an area along the mixer body where product is not mechanically moved directly by the agitator arms, but rather the product is only moved by the motion of the mass of product in the mix. Further, the chopper 16 can disrupt a desired balance flow of the product along the agitator(s) in the trough by re-directing or spraying the product in a different direction because of the spinning of the blades.

The present invention seeks to address one or more difficulties of these prior art designs to provide an improved design for chopper for a mixer.

SUMMARY OF THE INVENTION

In one aspect of the invention, a mixer for mixing and/or blending granular materials has a trough for receiving the granular materials therein, and an agitator disposed in the trough for mixing or blending the granular materials therein. A zone of fluidized flow of the granular material is created above the agitator, and a chopper is disposed in the zone of fluidized flow.

In another aspect of the invention, a mixer for granular materials includes a trough for receiving the granular materials therein, and an agitator disposed in the trough for mixing the granular materials therein. A zone of flow of granular material across the agitator is created above the agitator, and a chopper is disposed in the zone of flow.

In a further aspect of the invention, a fluidizing mixer includes a trough for receiving product for mixing therein, and an agitator disposed in the trough for mixing the product, wherein a zone of fluidized flow of the product is created above the agitator. A first set of chopper blades is on a first shaft and a second set of chopper blades is on a second shaft. Each shaft projects inwardly into the trough from a wall of the trough, and the first set of chopper blades and the second set of chopper blades intersect at a region of overlap in the zone of fluidized flow. A drive assembly on an opposite side of the wall rotates the first shaft and the second shaft in opposing directions upwardly at the overlap, wherein the rotation of the first and second sets of chopper blades is synchronized.

Other aspects and advantages of the present invention will become apparent upon consideration of the following detailed description.

DETAILED DESCRIPTION

Figure 1A:
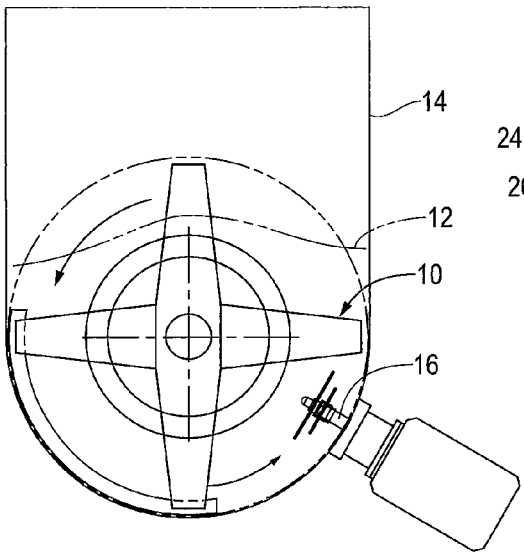
FIG. 1A PRIOR ART
FIGS. 1A, 1B, and 1C are views of different U-shaped mixers with choppers according to the prior art.
Figure 1C:
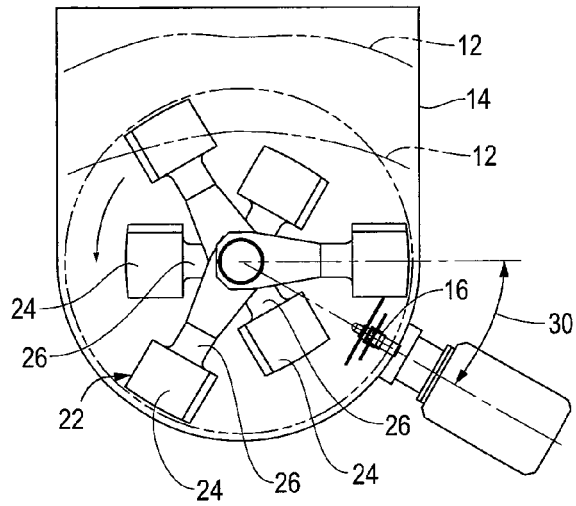
FIG. 1C PRIOR ART
Figure 1B:
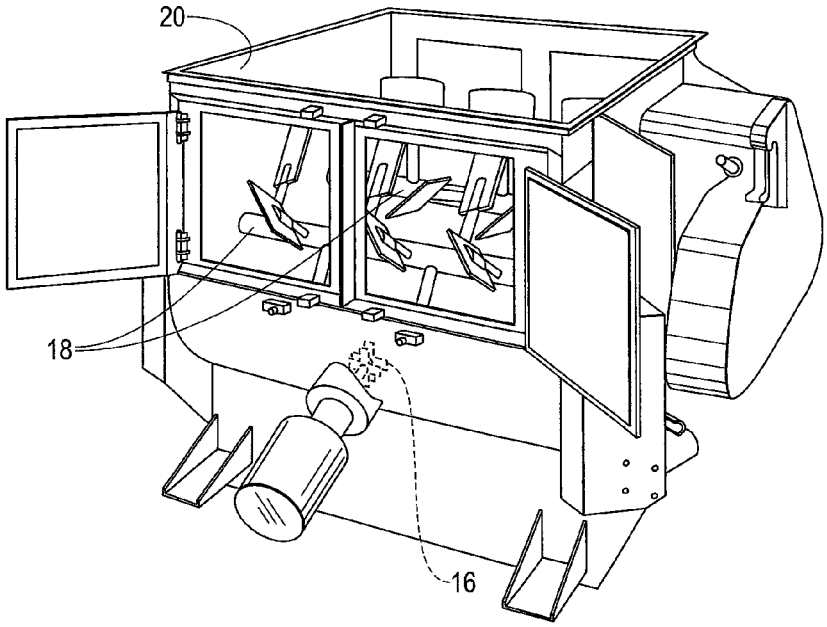
FIG. 1B PRIOR ART
Figure 2:
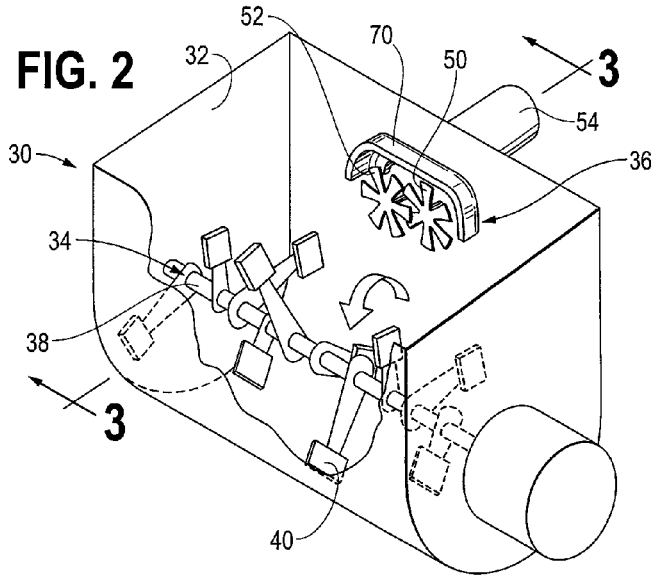
FIG. 2 is an isometric view of a mixer with a chopper according to the present invention.

Turning now to the drawings, in FIG. 2 a mixer 30 for blending and/or mixing product in a trough 32 includes an agitator assembly 34 and a chopper assembly 36 disposed above the agitator assembly 34 according to one aspect. The mixer 30 may be any type sufficient to blend and/or mix products therein and cause the product to engage the chopper assembly 36 to simultaneously mix and chop the product in the trough. For example, the mixer 30 according to a preferred embodiment is a fluidized paddle mixer and may utilize a multiple zone hybrid paddle agitator, such as the agitator assembly 24 of the mixer shown in FIG. 1C, and incorporates an innovative new chopper as described further herein to create a unique mixing and chopping and/or homogenizing apparatus. The mixer can be used to mix and/or blend granular materials of many types, such as grains, powders, pills, pellets, chunks, flakes, leaves, and other similar materials, and mixtures thereof. The trough 32 includes an elongate U-shaped shell with a curved bottom, opposing straight sidewalls extending upwardly from opposite sides of the curved bottom, and opposing end walls at opposite ends of the U-shaped shell. Other types and shapes of mixers may be used in accordance with the teachings of the present invention.

The agitator assembly 34 includes a shaft 38 extending horizontally along an axis of the trough 32 and agitators 40 projecting radially outwardly from the shaft 38. The shaft 38 is turned by a drive mechanism sufficient to turn the shaft, such as a motor, as would be understood in the art. Each agitator 40 includes an arm projecting radially away from the shaft 38 and a paddle disposed at a distal end of the arm. The arms extend at least two different lengths radially from the shaft 38 to create the multiple zones of flow through the mixer 30 as generally described with regard to FIG. 1C. The agitator assembly 34, in operation, defines a circular cylindrical sweep zone 42 in which the agitators 40 move in a counterclockwise direction as viewed in FIG. 3. The sweep zone 42 extends along the bottom of the trough 32 axially aligned with the axis of the U-shaped shell and preferably extends to the interior surface of the curved bottom of the trough to ensure complete engagement with the product. Preferably, although not necessarily, the agitator assembly 34 creates a zone 44 of fluidized flow of the product above the agitators 40 by, for example, combining hybrid inner and outer paddle designs and using higher axial speeds to throw product upwardly into the zone 44 of fluidized flow where the product is temporarily floating or suspended in the air, for example. Other types of agitators may be used, such as spiral agitators, ribbon agitators, blades, and/or other types sufficient to mix and/or blend the product in a manner consistent with the aims of the mixer. The agitator 40 in this style of fluidized mixer/blender is believed to create less shear and be gentler on the product, require a shorter time to achieve a desired homogeneity of product mix, and consume less power than traditional low-speed blenders and mixers.

Figure 3:
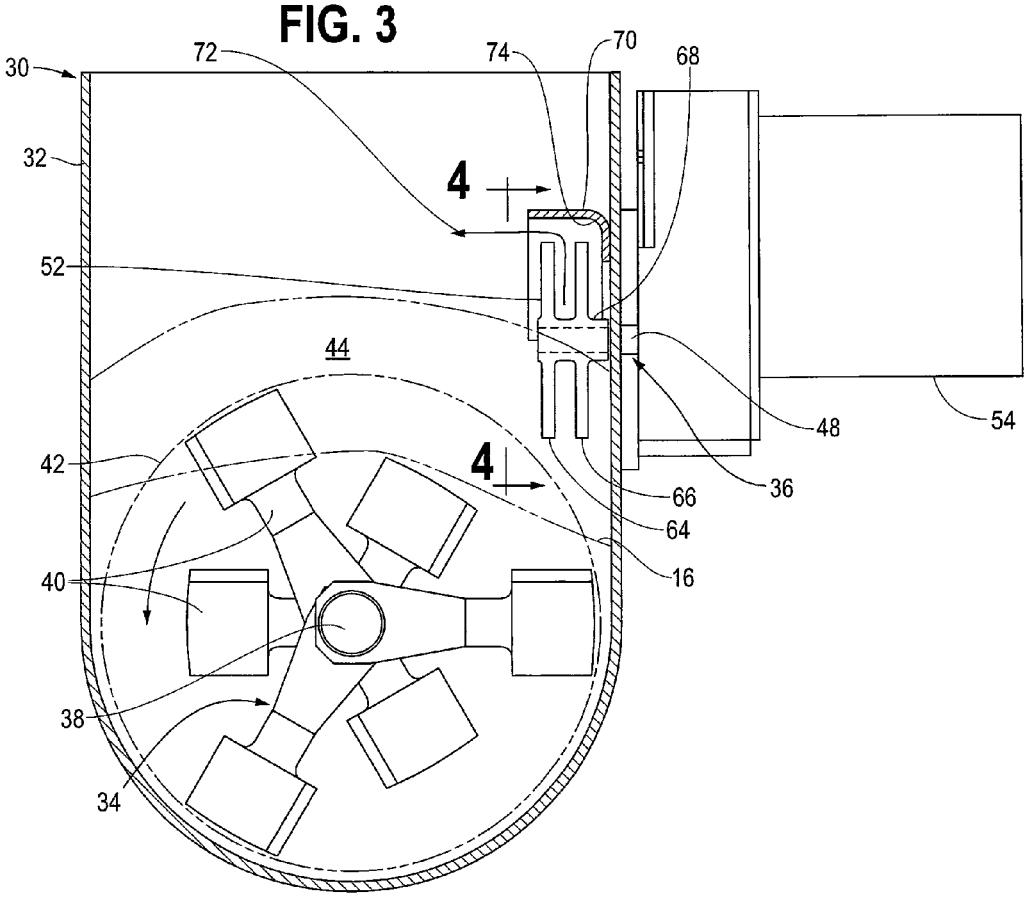
FIG. 3 is a cross-sectional view of the mixer along the lines 3-3 of FIG. 2.
Figure 4:
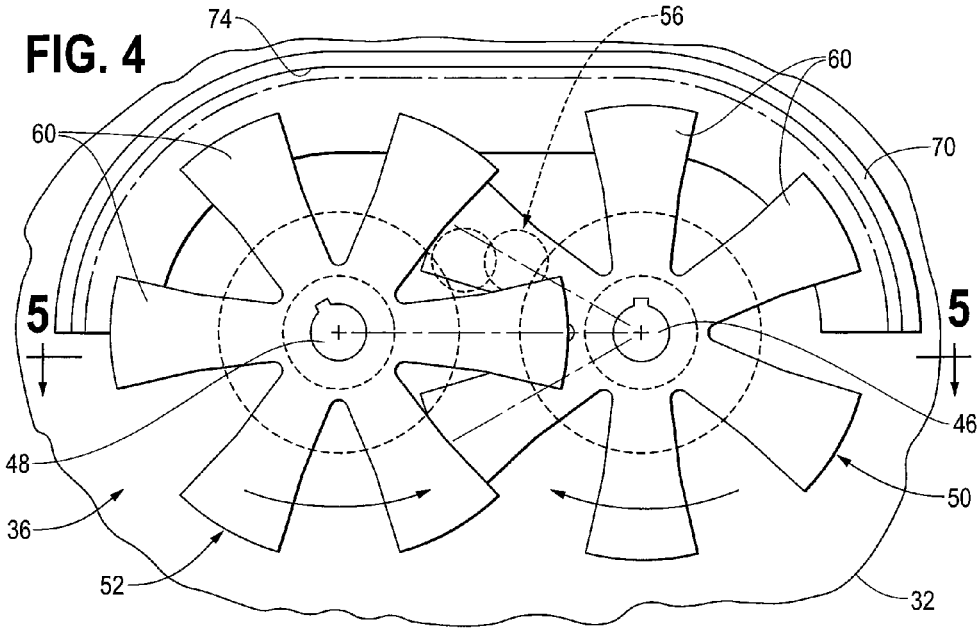
FIG. 4 is an enlarged front detail view of the chopper along the lines 4-4 of FIG. 3.
Figure 5:
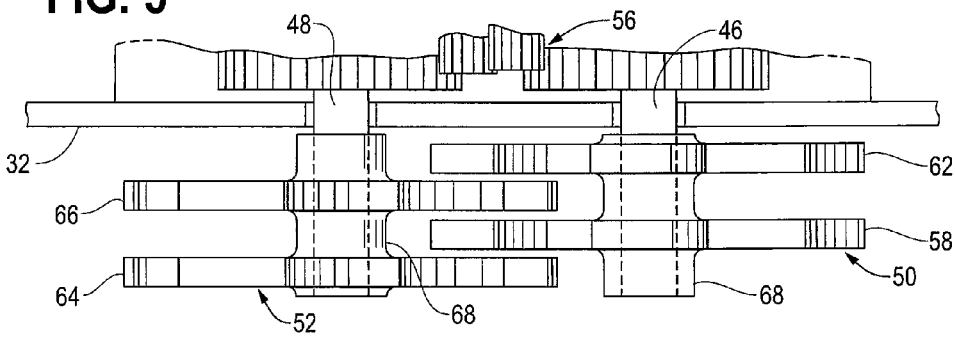
FIG. 5 is an enlarged partial cross-sectional of the chopper along the lines 5-5 of FIG. 4.

As best seen in FIGS. 3-5, the chopper assembly 36 projects inwardly into the trough 32 from the inner surface of the shell into the zone 44 of fluidized flow above the agitators 40. The chopper assembly 36 includes two shafts 46, 48 projecting through the inner wall surface of the upper straight section of the trough 32, a first set 50 of chopper blades on the shaft 46 and a second set 52 of chopper blades on the shaft 48. A drive mechanism, such as a motor 54 and a gear assembly 56 in a gearbox for driving the shafts 46, 48, is located on an exterior side of the shell 32 for rotating the chopper blades. The shafts 46, 48 protrude out the side of the gearbox and through the side wall of the trough 32, and the first and second sets 50, 52 of chopper blades are located at least partly in a wedge-shaped region in the trough 32 defined by the inner wall surface of the trough and the adjacent upper portion of the circular sweep zone 42 of the agitator assembly 34. The first set 50 of chopper blades and the second set 52 of chopper blades overlap and rotate in opposing directions. Preferably, both sets 50, 52 of chopper blades are identical, symmetrical and interchangeable, wherein each set of chopper blades 50, 52 has two spaced apart planar levels of blades extending radially outwardly in a star-shaped pattern. The first set of chopper blades 50 includes a first level 58 of six blades 60 projecting radially from the first shaft 48 and a second level 62 of six chopper blades 60 projecting radially from the first shaft 48, wherein the first level 58 of chopper blades is spaced longitudinally along the shaft 46 from the second level 62 of chopper blades. Similarly, the second set of chopper blades 52 includes a first level 64 of six chopper blades 60 projecting radially from the second shaft 48 and a second level 66 of six chopper blades 60 projecting radially from the second shaft 48, wherein the two levels 64, 66 of chopper blades are spaced apart longitudinally along the shaft 48. Each set 50, 52 of chopper blades is preferably connected by a single collar 68 with a keyway. The first set 50 of chopper blades is located on a keyed end of the shaft 48 with the blades immediately adjacent the side wall of the trough 32, and the second set 52 of blades is inverted and located on a keyed end of the shaft 48 with the blades spaced further away from the side wall of the trough 32. The blades 60 intersect with the third level 66 of chopper blades extending between the first and second levels 58, 62 of chopper blades, and the second level 58 of chopper blades extending between the third and fourth levels 66, 64 of chopper blades, as best seen in FIG. 5.

The rotation of the first and second sets 50, 52 of chopper blades preferably is synchronized to chop the product into a preselected size range, reduce the amount of energy required to drive the chopper blades, maintain even flow of the product in the trough, and/or disrupt the flow of product in the zone of fluidized flow as little as possible. For example, the rotation may be synchronized so that the first and second sets 50, 52 of chopper blades rotate in counter or opposing directions, with the first set 50 of chopper blades rotating clockwise and the second set 52 of chopper blades rotating counter clockwise (as viewed in FIG. 4) whereby both the first and second sets 50, 52 of chopper blades rotate upwardly at the region of overlap. Preferably, the rotation is also synchronized such that the first and second sets 50, 52 of chopper blades rotate at the same angular velocity and outer circumferential velocity. The first and second sets 50, 52 of chopper blades also may be synchronized such that a preselected gap or overlap is maintained between a leading edge of each of the blades of the first set of chopper blades and a trailing edge of each of the blades of the second set of chopper blades at a given point of reference. Preferably, the rotation is synchronized such that of one set 50 of blades rotates out of phase with the other set 52 of blades a constant angle, such as at an angel equal to one half of a an angle defined between radial centerlines of each two adjacent blades 60. Thus, for example, when a centerline of a blade 60 is aligned with the centerline of the shaft 46 of the opposite set of blades, the centerline of the blade 60 bisects an angle defined between centerlines of adjacent blades 60 on the opposite set of blades, as shown in FIG. 4. The rotation of the chopper blades 60 may be synchronized with a set of spur gears in the gear assembly 56 in an oil bath and connected to the shafts 46, 48 and a two horsepower drive motor 54, although other motor sizes, such as three horsepower, five horsepower, or other size motors, may be used, and other synchronization systems, such as belts, chains, and/or servo motors, may be used. Different blade sizes, configurations, and synchronization parameters may be implemented as necessary for different products and to balance different needs as would be apparent to one skilled in the art. In one embodiment, the output of the blades is 3600 revolutions per minute, and the blades are machined from a steel billet to tight tolerances between the intersecting blades.

A shroud 70 projects out from the inner surface of the trough 32 above the chopper blades 60 to redirect the path 72 of granular materials thrown upwardly by the chopper blades 60 laterally back into the zone 44 of fluidized flow as best shown in FIG. 3. The shroud 70 has a downwardly directed elongate U-shaped deflection surface 74 (as seen from the front in FIG. 4) opposing the blades that extends outwardly from the inner surface of the trough 32 above both the first and second sets 50, 52 of chopper blades. Preferably, the deflection surface also extends downwardly around opposite side edges of chopper assembly 36. The deflection surface 74 has a rounded cross-section, such as a quarter-round radius as seen in FIG. 3, which smoothly transitions from the plane of the blades outwardly toward the zone 44 of fluidized flow and thereby smoothly deflects product thrown radially up and/or sideways from the chopper blades back outwardly laterally across the zone 44 of fluidized flow. An angled deflection surface, such as would be the result of using an angle-iron, would also work, but may not deflect the product as smoothly as a rounded deflection surface and/or may be more susceptible to undesired vertical bounce-back and/or becoming caked with product in the corner of the angle. The shroud 40 may be a simple curved member, such as a metal bar, angle iron, or quarter-round member, bent to the upside-down elongate U shape and welded to the inner surface of the trough 32 above the chopper blades 60 as shown in FIG. 4. The shroud 70 may take other shapes and forms, such a simple straight horizontal bar above the chopper blades, a pair of un-connected partial deflectors above one or both of the sets 50, 52 of chopper blades, or other positions and shapes capable of redirecting the product sprayed upwardly from the chopper blades 60 laterally back into the zone 44 of fluidized flow. However, it has been found by the inventor that using a shroud that covers both sets 50, 52 of chopper blades as shown in FIG. 4 provides the most satisfactory results to re-direct the greatest amount of product dispersed radially by the chopper blades back into the zone 44 of fluidized flow with the least amount of disruption to mixing/blending flow of the product along the agitator assembly 34.

Figure 6:
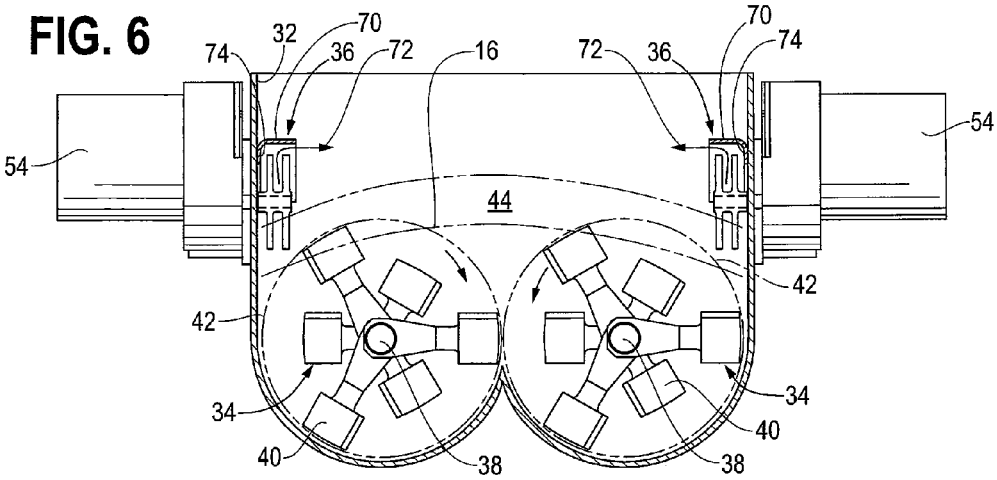
FIG. 6 is cross-sectional view of another mixer according to the present invention.

The type of mixer and number of choppers in any mixer is not limited to the example of FIGS. 2-5. Rather, a chopper assembly 36 according to the concepts of the disclosure may be used with many different types of mixers and in many different configurations. For example, turning now to FIG. 6, a variation on the mixer 30 of FIGS. 2-5 is shown, wherein like reference numbers are used to refer to substantially similar structures. The mixer 30 has a plurality of agitator assemblies 34 and a chopper assembly 36 disposed above each agitator assembly 34. The mixer 30 has two parallel drive shafts 38, wherein each drive shaft 38 has a number of radial agitators 40 as disclosed in FIG. 2, and each agitator assembly 34 is disposed in a U-shaped section of the trough 32. The drive shafts 38 are spaced apart and/or the radial agitators 40 are spaced along the shafts 38 such that the radial agitators 40 do not interfere with each other when rotating. Preferably, each agitator assembly 34 defines a cylindrical sweep zone 42, wherein the sweep zones 42 are adjacent each other, the left agitator assembly 34 (as viewed in FIG. 6) rotates clockwise and the right agitator assembly 34 (as viewed in FIG. 6)

rotates counter-clockwise such that each agitator assembly 34 throws product upwardly along an adjacent inner wall surface of the trough 32. A chopper assembly 36 substantially the same as described previously is disposed above each agitator assembly 34, and operates in a substantially similar manner as described with respect to FIGS. 2-5.

In use of the mixer of FIGS. 2-5, product in the trough is agitated and mixed by rotation of the agitator assembly 34, which simultaneously urges some of the product upwardly against the rotating chopper blades 60. The chopper blades 60 mill the product and spray the milled product upwardly against the shroud 70, which redirects the milled product back outwardly laterally over the agitator assembly 34, preferably into the zone 44 of fluidized flow. Preferably, the chopper assembly 36 is located at a functionally central position along the length of the agitator assembly 34 in order to maintain balanced longitudinal movement of the product in the trough 32, or multiple chopper assemblies 36 may be located along the agitator assembly 34 at symmetric or functionally symmetric positions for the same reason. Use of the mixer of FIG. 6 would be substantially similar to that of the mixer in FIGS. 2-5 as would be understood by a person of ordinary skill.

The mixer and chopper combinations disclosed herein may be made in any method and of any materials sufficient for the purposes disclosed and/or suggested herein and/or within consideration by an artisan. Preferably, the mixer and chopper assemblies are formed substantially of metal, such as stainless steel, and manufactured in standard manners, such as with known shaping and joining techniques. Motors, wiring, seals, fasteners, and other standard items known or obvious to one skilled in the art may be used in well understood manners to complete fabrication of a preferred embodiment.

INDUSTRIAL APPLICABILITY

Combining the mixer and chopper assemblies disclosed herein creates a new configuration that addresses problems encountered by the traditional art. For example, locating the chopper out of the mixing zone does not interfere with the agitator tool sweeping the shell. Further, locating the chopper above the agitator assembly, such as in the zone of fluidized flow, can greatly reduce the amount of power needed to operate the chopper, the synchronized motion of the chopper blades can reduce disruption to the flow of product in the mixer along the agitator assembly, and the shroud can further maintain preferable flow of product in the mixer.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent applications, and other printed publications identified in this foregoing are incorporated by reference in their entireties herein.

I claim:

1. A mixer for mixing and/or blending granular materials, comprising:

a trough for receiving the granular materials therein;

an agitator disposed for rotation about a substantially horizontal axis of the trough for mixing or blending the granular materials therein, wherein a zone of fluidized flow of the granular material is created above the agitator; and a chopper disposed in the zone of fluidized flow substantially at a central position along the horizontal axis of the trough.

2. A mixer for mixing and/or blending granular materials, comprising:

a trough for receiving the granular materials therein;

an agitator disposed in the trough for mixing or blending the granular materials therein, wherein a zone of fluidized flow of the granular material is created above the agitator; and a chopper disposed in the zone of fluidized flow, wherein the chopper comprises a first set of chopper blades on a first shaft and a second set of chopper blades on a second shaft, wherein the first set of chopper blades and the second set of chopper blades overlap and rotate in opposing directions.

3. The mixer of claim 2, wherein the first and second sets of chopper blades rotate upwardly at the overlap.

4. The mixer of claim 3, wherein the first set of chopper blades includes a first chopper blade projecting radially from the first shaft and a second chopper blade projecting radially from the first shaft, the first chopper blade spaced longitudinally along the shaft from the second chopper blade, and wherein the second set of chopper blades includes a third chopper blade projecting radially from the second shaft and a fourth chopper blade projecting radially from the second shaft, the chopper third blade spaced longitudinally along the shaft from the fourth chopper blade.

5. The mixer of claim 4, wherein the third chopper blade extends between the first chopper blade and the second chopper blade.

6. The mixer of claim 3, wherein the first and second sets of chopper blades rotate at the same angular velocity.

7. The mixer of claim 6, wherein one set of the chopper blades rotates out of phase with the other set of chopper blades a preselected angle.

8. The mixer of claim 3, further comprising a shroud extending above the first and second sets of chopper blades, wherein the shroud redirects granular materials thrown upwardly by the chopper laterally back into the zone of fluidized flow.

9. The mixer of claim 8, wherein each of the first and second shafts project outwardly from an inner wall of the trough above the agitator, and the shroud comprises an elongate deflection surface extending across both the first and second sets of chopper blades.

10. The mixer of claim 9, wherein the deflection surface extends downwardly around opposite edges of chopper.

11. The mixer of claim 10, wherein the deflection surface comprises a rounded surface which smoothly transitions from a plane of the blades outwardly toward the zone of fluidized flow.

12. The mixer of claim 1, wherein the chopper is carried by wall portion of the trough, and wherein the wall portion is removably attached to surrounding portions of the trough with fasteners, and wherein the chopper may be removed from the trough by detaching the wall portion from the surrounding portions of the trough.

13. The mixer of claim 1, wherein the trough defines an elongate U-shaped inner surface with a curved bottom portion that defines a radial axis, and the agitator comprises a multiple-zone hybrid paddle agitator comprising a shaft extending along the radial axis and a plurality of agitator arms projecting radially from the shaft and carrying paddles at a second plurality of lengths from the shaft, wherein the agitator blades move the granular material both longitudinally along the shaft and radially around the shaft in a plurality of different fluidized zones, each zone having fluidized movement of the granular material in a different direction.

14. A mixer for granular materials, comprising:

a trough for receiving the granular materials therein;

an agitator disposed in the trough for blending the granular materials therein, wherein a zone of flow of granular material across the agitator is created above the agitator; and a chopper disposed in the zone of flow and comprising a first set of chopper blades on a first shaft and a second set of chopper blades on a second shaft, wherein the first set of chopper blades and the second set of chopper blades overlap and rotate in opposing upwardly directions at the overlap.

15. The mixer of claim 14, wherein the zone of flow comprises a zone of fluidized flow of the granular material created by the agitator.

16. The mixer of claim 14, further comprising a shroud extending over the first and second sets of chopper blades, wherein the shroud comprises a rounded deflection surface that extends downwardly on opposite sides of the chopper and smoothly redirects granular materials thrown upwardly by the chopper laterally back into the zone of fluidized flow.

17. The mixer of claim 14, further comprising a second agitator disposed in the trough, wherein the second agitator is parallel with the first agitator.

18. A fluidizing mixer, comprising:

a trough for receiving product for mixing therein;

an agitator disposed in the trough for blending the product, wherein a zone of fluidized flow of the product is created above the agitator;

a first set of chopper blades on a first shaft and a second set of chopper blades on a second shaft, wherein each shaft projects inwardly into the trough from a wall of the trough, and wherein the first set of chopper blades and the second set of chopper blades intersect at a region of overlap in the zone of fluidized flow; and a drive assembly on an opposite side of the wall that rotates the first shaft and the second shaft in opposing directions upwardly at the overlap, wherein the rotation of the first and second sets of chopper blades is synchronized.

19. The chopper of claim 18, wherein the first set of chopper blades includes a first chopper blade projecting radially from the first shaft and a second chopper blade projecting radially from the first shaft, the first chopper blade spaced longitudinally along the shaft from the second chopper blade, and wherein the second set of chopper blades includes a third chopper blade projecting radially from the second shaft and a fourth chopper blade projecting radially from the second shaft, the chopper third blade spaced longitudinally along the shaft from the fourth chopper blade, wherein the third chopper blade extends between the first chopper blade and the second chopper blade; and further comprising a shroud extending above the first and second sets of chopper blades, wherein the shroud redirects granular materials thrown upwardly by the chopper laterally back into the zone of fluidized flow.

* * * * *